US006601715B2

(12) United States Patent
Hardy

(10) Patent No.: US 6,601,715 B2
(45) Date of Patent: Aug. 5, 2003

(54) STORAGE UNITS AND COMPONENTS FOR USE IN THEIR CONSTRUCTION

(75) Inventor: Terence Hardy, Belper (GB)

(73) Assignee: L. B. Plastics Limited, Derbyshire (GB)

( * ) Notice: Subject to any disclaimer, the term of this patent is extended or adjusted under 35 U.S.C. 154(b) by 0 days.

(21) Appl. No.: 10/020,024

(22) Filed: Dec. 7, 2001

(65) Prior Publication Data

US 2002/0074303 A1 Jun. 20, 2002

(30) Foreign Application Priority Data

Dec. 15, 2000 (GB) ..... 0030598

(51) Int. Cl.[7] ..... A47B 47/05
(52) U.S. Cl. ..... 211/188
(58) Field of Search ..... 211/188; 52/793.11

(56) References Cited

U.S. PATENT DOCUMENTS 2,246,448 A * 6/1941 Mahan, Jr. ..... 211/188
2,912,119 A 11/1959 Robinson
3,331,514 A 7/1967 Bruynzeel
3,439,812 A 4/1969 Nagelkirk et al.
4,995,323 A * 2/1991 Kellems et al. ..... 211/135
5,188,246 A 2/1993 Maxworthy
5,218,914 A 6/1993 Dickinson
5,579,702 A * 12/1996 Aho ..... 108/92
5,709,158 A 1/1998 Wareheim
5,964,163 A 10/1999 Cohen
5,971,174 A * 10/1999 Strock ..... 211/186

FOREIGN PATENT DOCUMENTS

EP 0 250 612 A1 1/1988
GB 1 270 569 A 4/1972

* cited by examiner

*Primary Examiner*—Daniel P. Stodola
*Assistant Examiner*—Erica B. Harris
(74) *Attorney, Agent, or Firm*—Adams Evans P.A.

(57) ABSTRACT

A load-bearing plank-like member is adapted to be supported by its ends on support members having peg members engageable with complementary apertures in the plank member. The plank member is of hollow cross-section and incorporates at least one internal longitudinal web disposed parallel to the upper, load bearing surface of the plank member, the web being spaced from the underside of the plank member by a distance less than the length of said peg members. Vertically aligned complementary apertures are formed in the underside of the plank member and in the web, whereby when the plank member is engaged with the support member each of the pegs engages with apertures both in the underside of the member and in the web.

12 Claims, 2 Drawing Sheets

STORAGE UNITS AND COMPONENTS FOR USE IN THEIR CONSTRUCTION

This invention relates to storage units in the form of shelving and components for use in their construction.

Various systems have previously been proposed for constructing shelving from kits of components. One such system includes a plurality of support members adapted to be attached to a wall or like structure and to which shelf members are attached by means of brackets engageable with the support members. Such arrangements require the use of tools to effect assembly, result in damage to the fabric of the wall or other support and are not readily moved from one location to another.

It has also been proposed to construct shelf units from a plurality of timber uprights between which shelf members are mounted to form a free-standing assembly. Such arrangements also require the use of tools to effect assembly and can be erected to form an assembly of only one predetermined height and width. Such systems are not readily disassembled and can only be relocated in locations where wall space of the same dimensions is available.

In our co-pending U.K. patent application No. 0030597.9 there is disclosed a set of components for the construction of a shelf assembly comprising at least four uprights of a length approximating to a predetermined shelf spacing, at least one shelf member, and a plurality of locating members engageable with said uprights and provided with locating means engageable with the or each shelf member to form a shelf assembly supported on the uprights. The present invention is concerned with shelf components which may be used with such shelf assemblies or in other situations where rigidity under load is required.

The invention provides a load-bearing plank-like member adapted to be supported by its ends on support members having a plurality of peg members engageable with complementary apertures in the plank member, in which the plank member is of hollow cross-section and incorporates at least one internal longitudinal web disposed parallel to the load bearing surface of the plank member, said web being spaced from the underside of the plank member by a distance less than the length of said peg members, vertically aligned complementary apertures being formed in the underside of the member and in said web, whereby when the plank member is engaged with said support member each of said pegs engages with apertures both in the underside of the member and in said web.

Preferably said web is disposed closer to the upper load-bearing surface of the plank member than to the underside of the plank member.

Preferably said pegs and said apertures are of circular cross-section. Preferably also at least two pairs of aligned apertures are provided at each end of the plank-like member. The plank-like member is preferably formed from plastics material by extrusion.

The internal longitudinal web member may extend across the full width of the plank member. Preferably however the plank member incorporates one or more vertically disposed, longitudinally-extending, internal web members defining a plurality of adjacent longitudinally-extending cavities, the horizontal web member or members extending across at least one and preferably two or more of said cavities.

Advantageously, the plank-like member may comprise a slat, a plurality of which are located adjacent to one another in spaced parallel relationship to define a shelf. Preferably the pegs with which said apertures of the respective plank members engage are all mounted on a common support member.

Thus the invention also provides a set of components for the construction of a shelf assembly comprising at least two support members provided with upstanding peg members and at least one plank member as aforesaid adapted for engagement at its opposite ends with respective ones of the support members to extend therebetween.

The support members may comprise uprights adapted to form end supports for a shelf assembly. Alternatively the support members may comprise brackets adapted to be mounted on a wall or other support between which the plank member extends.

The plank member may be of a width sufficient of itself to form a shelf. Alternatively the plank member may comprise a narrow slat, a plurality of which are mounted side by side on said support members to define a shelf between them.

The invention also provides a shelf assembly or like load-bearing structure constructed from a set of components as aforesaid.

An embodiment of the invention will now be described, by way of example only, with reference to the accompanying drawings, in which.

Figure 1:
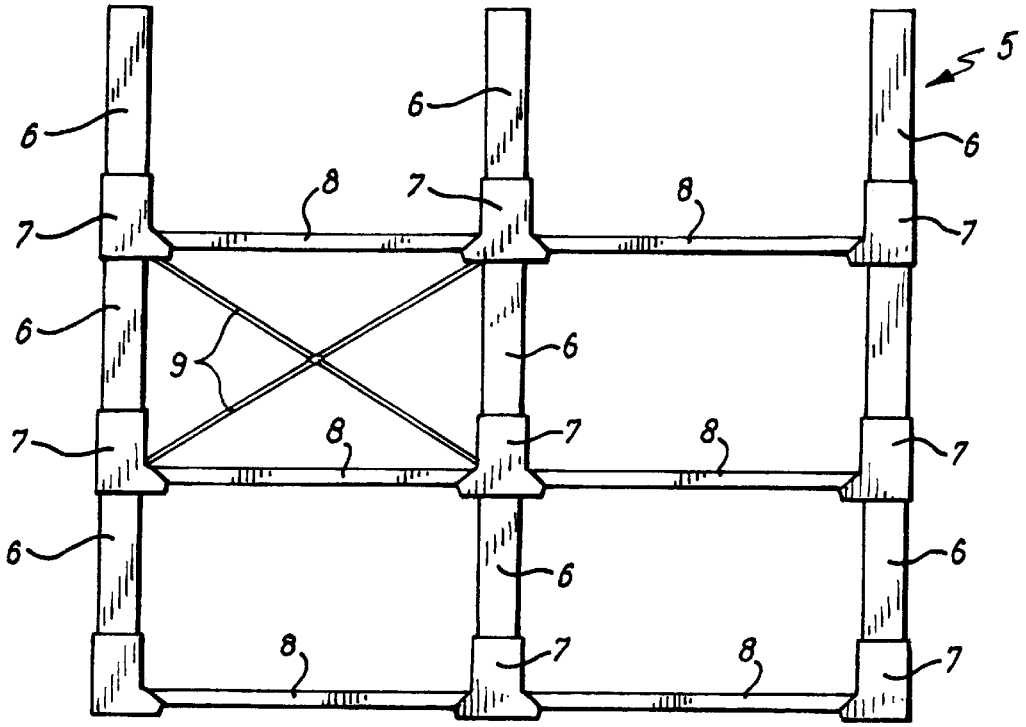
FIG. 1 is a front elevation of a shelf assembly constructed from components according to the invention.

Referring to the drawings, FIG. 1 shows a self-standing shelf assembly 5 constructed from a plurality of uprights 6 interconnected by locating members 7 between which shelves 8 extend. The unit is assembled from a plurality of the components 6, 7 and 8 interconnected, in the illustrated example, to form a unit having a base and shelves at two heights each consisting of two shelf members arranged alongside one another. The same components may be employed to produce a variety of heights and widths of shelf unit adapted to different locations. While the construction of the components is such as to produce a relatively rigid self-standing structure, additional rigidity may be imparted, if desired, by means of cross braces 9.

Figure 2:
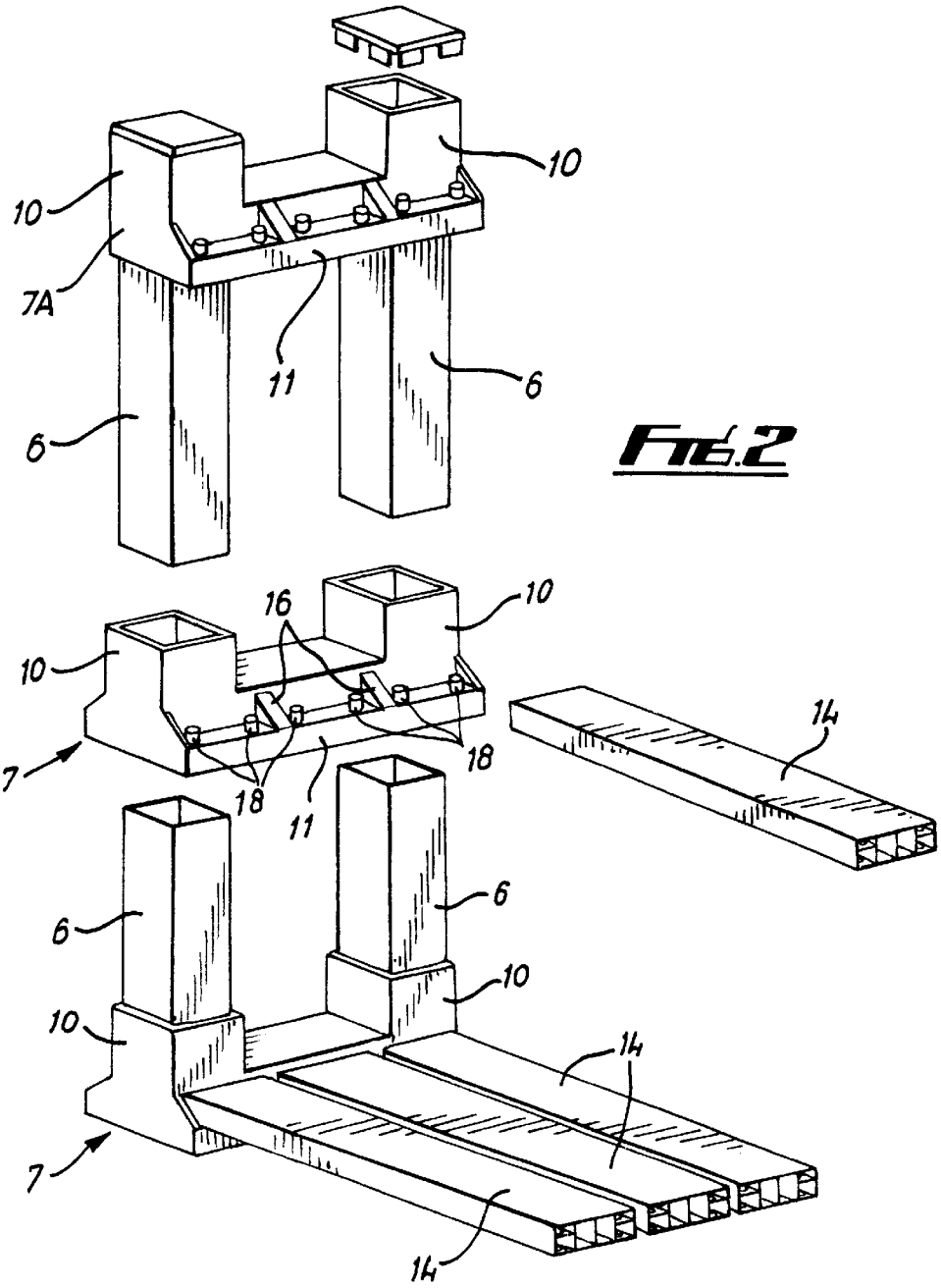
FIG. 2 is an exploded perspective view showing components from which an assembly according to FIG. 1 may be constructed.

Referring to FIG. 2 of the drawings, each of the uprights 6 comprises a hollow box-like member of square cross-section and of a length approximating to the desired distance between vertically spaced shelves of the assembled unit. Since in most instances the assembled unit will consist of at least two and possibly three or more shelves spaced vertically above one another, the lengths of the uprights are relatively short compared to the likely overall height of most shelf units to be assembled from the components.

Each pair of uprights 6 are spaced apart and interconnected by a locating member 7 comprising a pair of sockets 10 interconnected by a shelf support member 11. Each of the sockets 10 is shaped and dimensioned to receive an end of an associated upright 6, the construction of the sockets 10 being such that they are supported on the upper ends of lower uprights 6 and are adapted in turn to support the lower ends of upper uprights 6. Several uprights may be interconnected vertically by locating members 7 in this manner to provide end supports for shelf units of a variety of different heights.

Figure 3:
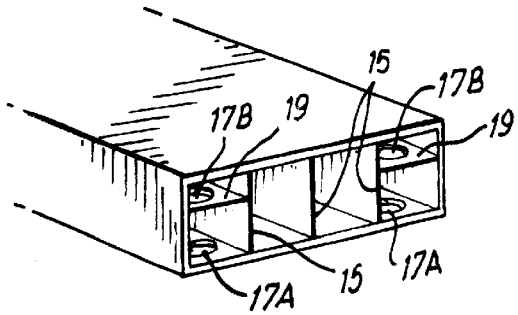
FIG. 3 is an enlarged fragmentary view of one end of a shelf member showing the internal construction.

In the illustrated embodiment, each shelf member 8 is formed from three plank members 14, opposite ends of which are supported on the shelf support members 11 which interconnect each pair of sockets 10. Each plank member 14 is formed from synthetic plastics material by extrusion and is of hollow construction provided with internal reinforcing ribs 15 (FIG. 3). The lengths and wall thicknesses of the planks are selected such as to minimize bowing of the shelf members 8 under the maximum load recommended for use with the assembled unit.

Inclined web members 16 divide each shelf support member 11 into three sections corresponding in width to the respective plank members 14.

Pairs of apertures 17A are formed in the under surface of each end of each plank member 14 and are adapted to locate over upwardly projecting detents or pegs 18 on the shelf support member 11. The plank members 14 thus link and space apart the locating members 7 at each level of the assembled unit by a distance equal to the length of the plank members.

As best seen in FIG. 3, the plank members 14 are provided with additional internal longitudinally-extending, horizontal web members 19 incorporating apertures 17B corresponding in shape and size to and aligned with the apertures 17A. The length of the detents or pegs 18 on the shelf support members 11 is such that, when the plank members 14 are engaged with the shelf support members, each detent 18 engages both of the associated vertically-aligned apertures 17A and 17B. This considerably increases rigidity and resistance to bowing of the plank members 14 compared with the position were the apertures 17A only provided.

In assembling a shelf unit from the components, end supports are first constructed from a desired number of uprights 6 and locating members 7, following which the end supports are connected to one another by engagement of the plank members 14 with the detents 18 on the shelf support members 11. Thus in the case of the unit shown in FIG. 1, three end supports would first be assembled and then interconnected by six groups of plank members 14 to form the shelves 8, thus providing a unit having a base and two shelves at different heights with two adjacent shelves 8 at each height.

An advantageous feature of the system is that the uprights 6 are located at the ends of the assembled shelf unit and do not project forwardly or rearwardly from the forward and rear edges of the shelves. This results in a particularly compact unit in addition to imparting rigidity and being of pleasing aesthetic appearance. The construction of the sockets 10 imparts stability to the uprights 6 engaged within them and thus serves the dual function of rigidifying the end units and forming locating members for the ends of the shelves themselves. The web members 16 and detents 18 locate the plank members against lateral movement and the resulting structure is extremely stable and sufficiently rigid to form a self-standing unit not requiring attachment to a wall or similar structure. In addition the internal reinforcing web in the planks 14 together with the engagement of the detents or pegs 18 in the aligned apertures 17A and 17B in the underside of the planks 14 and in the internal webs 19, substantially reduces flexing of the shelves 8 under load and provides a relatively heavy duty assembly compared with the case if the internal webs 19 and associated apertures 17B were omitted.

The two lower locating members 7 shown in FIG. 2 of the drawings are provided with shelf support members 11 projecting from opposite sides to enable shelves to be provided at both sides of the locating members. The upper locating member 7A shown in FIG. 2 incorporates only one shelf support member 11 and is intended for use at an end of the assembled unit where shelves extend from the locating member in only one direction. Normal locating members 7 may however be used at the ends if desired.

By virtue of the relatively short length of the uprights 6, it is possible to assemble a plurality of the components in a variety of different ways to produce shelf units of different overall dimensions. Thus, for example, the components used to form the unit shown in FIG. 1, could instead be arranged to provide up to six shelves vertically above one another or could produce a unit having three sets of two shelves or three shelves above one another at one end, two central shelves and a further shelf at ground level at the other end. Systems consisting of greater numbers of components can be assembled in a considerable variety of different ways to provide shelf units adapted to different locations. As a result the system may readily be moved from one location to another in a house or the like and reassembled in a different manner adapted to the wall space available at the new location.

Components of the kind described may be sold in various combinations. The minimum kit would consist of four uprights, two locating members and one shelf member which may comprise a single component or two or more plank members of the kind shown in the drawings. Such a kit would enable the construction of only one shelf at a fixed height from the ground. A more usual basic kit might consist of twelve uprights, six locating members and three shelf members to produce a unit corresponding to one half of the unit shown in FIG. 1 of the drawings. By virtue of the nature of the components, a purchaser acquiring a basic system could subsequently acquire additional components to enable a shelf unit to be extended upwardly or to one side or to be reassembled to a different overall shape to suit an alternative location.

It should be noted also that assembly of shelf units from the components described may be effected without the use of tools. The uprights are a simple push fit in the opposite ends of the locating members and the plank members may be engaged with the detents on the shelf support members without the use of tools of any kind. Where bracing members 9 are provided the only tool required to fit them is a screwdriver.

Various modifications may be made without departing from the invention. For example the internal construction of the plank members may be altered in various ways. The vertical webs 15 may be omitted and a single longitudinal web 19 incorporated. The number and arrangement of apertures in the plank ends may be varied and the pegs or detents may be of different size or cross-section provided they are long enough to engage with the apertures 17B in the web or webs 19. The vertical position of the webs 19 may also be altered and additional vertically-aligned internal webs and associated apertures may be provided if desired.

While in the arrangement described the sockets into which the uprights engage are provided in interconnected pairs, separate individual sockets may be provided if desired. Interconnected sockets however contribute substantially to the rigidity of the assembled units and are preferred. Alternative means of engaging the locating members with the uprights may be employed and while it is preferred that the components are made from synthetic plastics material, they may be made from other materials if desired. Moreover while the invention has been described with reference to a self-standing shelf unit, it may also be used in conjunction with wall-mounted shelf units or other similar load-supporting structures if desired.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A load bearing plank member having an upwardly facing load bearing surface, and support members supporting opposite ends of said plank member, said support members having peg members engageable with complementary apertures in the plank member, in which the plank member is of hollow cross-section and incorporates at least one internal longitudinal web disposed parallel to the load bearing surface of the plank member, said web being spaced from the underside of the plank member by a distance less than the length of said peg members, and vertically aligned complementary apertures being formed in the underside of the plank member and in said web, whereby when the plank member is engaged with said support member each of said pegs engages with apertures both in the underside of the member and in said web.

2. A member according to claim 1 wherein said web is disposed closer to the upper load-bearing surface of the plank member than to the underside of the plank member.

3. A member according to claim 1 wherein said pegs and said apertures are of circular cross-section.

4. A member according to claim 1 wherein at least two pairs of aligned apertures are provided at each end of the plank-like member.

5. A member according to claim 1 which is formed from plastics material by extrusion.

6. A member according to claim 1 wherein said internal longitudinal web member extends across the full width of the plank member.

7. A member according to claim 1 including one or more vertically disposed, longitudinally-extending, internal web members defining a plurality of adjacent longitudinally-extending cavities, said internal longitudinal web comprising a horizontal web member or members extending across at least one and preferably two or more of said cavities.

8. A member according to claim 1 comprising a slat, a plurality of which may be located adjacent to one another in spaced parallel relationship to define a shelf.

9. A set of components for the construction of a shelf assembly comprising at least two support members provided with upstanding peg members and at least one plank member according to claim 1 adapted for engagement at its opposite ends with respective ones of the support members to extend therebetween.

10. A set of components according to claim 9 wherein said support members comprise uprights adapted to form end supports for a shelf assembly.

11. A set of components comprising a plank member according to claim 1 wherein the plank member is of a width sufficient of itself to form a shelf.

12. A set of components comprising a plank member according to claim 1 wherein the plank member comprises a narrow slat, a plurality of which may be mounted side by side on said support members to define a shelf extending between them.

* * * * *